United States Patent [19]

Coulter

[11] 4,157,116

[45] Jun. 5, 1979

[54] PROCESS FOR REDUCING FLUID FLOW TO AND FROM A ZONE ADJACENT A HYDROCARBON PRODUCING FORMATION

[75] Inventor: Gerald R. Coulter, London, England

[73] Assignee: Halliburton Company, Duncan, Okla.

[21] Appl. No.: 912,664

[22] Filed: Jun. 5, 1978

[51] Int. Cl.[2] ..... E21B 33/138; E21B 43/26

[52] U.S. Cl. ..... 166/280; 166/281; 166/292; 166/294

[58] Field of Search ..... 166/281, 280, 294, 285, 166/307, 308, 292, 293, 295

[56] References Cited

U.S. PATENT DOCUMENTS

| | | | |
|---|---|---|---|
| 2,229,177 | 1/1941 | Kennedy et al. | 166/294 |
| 2,681,704 | 6/1954 | Menaul | 166/281 |
| 2,784,787 | 3/1957 | Matthews et al. | 166/281 |
| 3,126,056 | 3/1964 | Harrell | 166/281 X |
| 3,127,937 | 4/1964 | McGuire, Jr. et al. | 166/281 X |
| 3,155,159 | 11/1964 | McGuire, Jr. et al. | 166/281 X |
| 3,227,212 | 1/1966 | Black et al. | 166/294 |
| 3,241,613 | 3/1966 | Kern et al. | 166/281 X |
| 3,687,203 | 8/1972 | Malone | 166/307 X |
| 3,818,990 | 6/1974 | Coulter | 166/281 X |
| 3,987,850 | 10/1976 | Fitch | 166/281 X |

*Primary Examiner*—Stephen J. Novosad

*Attorney, Agent, or Firm*—Thomas R. Weaver; J. H. Tregoning; William R. Laney

[57] ABSTRACT

A method for reducing fluid flow from and to a subterranean zone contiguous to a hydrocarbon producing formation which includes the steps of initially extending a common fracture horizontally into the zone and into the formation to locate a portion of the fracture in each of the zone and the formation, then introducing a porous bed of solid particles into that portion of the fracture located in the zone. A removable diverting material, such as a gel, is then introduced into the portion of the fracture located in the formation and adjacent the locus of the bed of solid particles to block the portion of the fracture occupied by the diverting material to a selected fluid sealing material. The selected sealing material is then introduced to the interstices of the particles in the porous bed, and is set to a fluid-impermeable seal to impede fluid flow to and from said zone. The diverting material is then removed to facilitate hydrocarbon production from the formation.

23 Claims, 5 Drawing Figures

Figure 1:
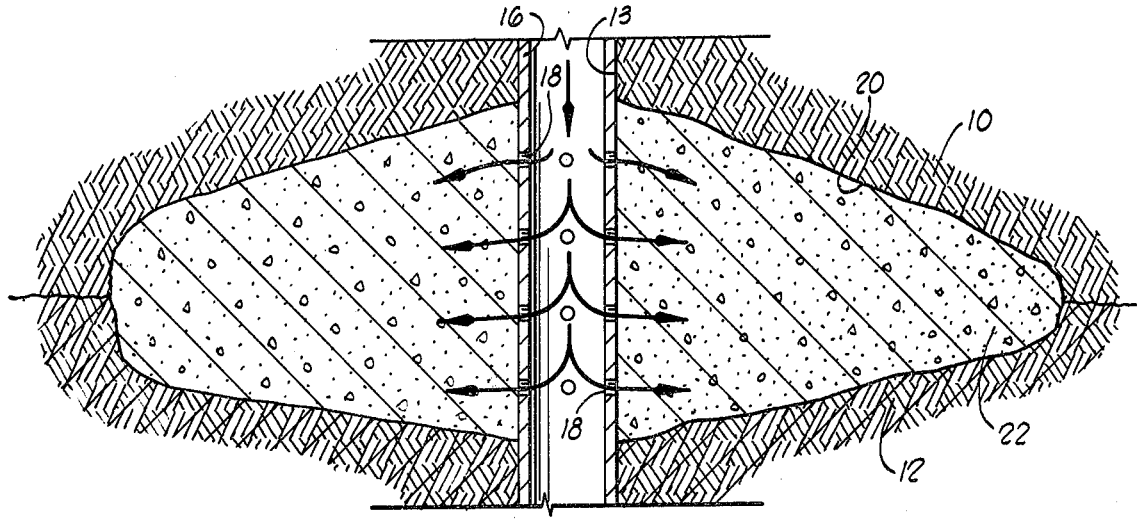

PROCESS FOR REDUCING FLUID FLOW TO AND FROM A ZONE ADJACENT A HYDROCARBON PRODUCING FORMATION

This invention relates to a process for reducing the undesirable flow of a fluid from or into a subterranean zone at a location adjacent a hydrocarbon producing formation. In one particularly useful aspect of the invention, the process is used for reducing or terminating the flow of water from a water-bearing zone or formation which is contiguous to the producing interval of a hydrocarbon-producing formation so as to prevent contamination of the produced hydrocarbons with water.

A well known and widely practiced technique for enhancing the production of hydrocarbons from a subterranean formation entails hydraulic fracturing of the formation with a pressurized fluid containing a particulate propping material. When the fracturing fluid is removed following development of the fracture, the propping material remains in place to mechanically prevent closure of the fracture.

Various conditions are sometimes encountered in fracturing which prevent optimization of the degree of production stimulation achieved thereby. At times, the fracture, or a portion of it, is intercepted by a zone which bears water, which therefore flows into the hydrocarbons entering the fracture and being produced therefrom. On other occasions, the fracture extends, in part, into a so-called thief zone, and because of the relatively high permeability of this zone, undesirable quantities of the fracturing fluid and/or the hydrocarbons may be lost to this zone.

Various procedures have been proposed for dealing with water-bearing zones and thief zones of the type described, and, in general, encompass efforts to isolate the deleterious zone from the fracture without effecting significant blockage of hydrocarbon flow to the well bore via the fracture. Cement or other sealing material is often employed to block the flow of water from the water-bearing zone into the fracture. In order to assure that the cementing is selective to the location of water origination (or fluid loss, in the case of thief zones), the producing interval is sometimes shielded or protected by placing a diverting agent in the fracture at that location so that the cementing shut of the hydrocarbon producing interval is avoided. After the cement or sealant is set up to block off or reduce fluid flow from, or loss to, the sealed formation, the diverting agent can be removed to restore production of hydrocarbons. Typical cementing or blocking procedures are described in U.S. Pat. Nos. 3,301,326 to McNamer, and 3,713,488 to Ellenburg, and the use of sodium silicate gels for sealing off thief zones is described in McLaughlin et al. U.S. Pat. No. 3,375,872.

The diverting agents used for temporarily closing off or shielding parts of the formation at a fracture face or other location adjacent a well bore are many, and generally are tailored to undergo releasing or breaking after a given time interval, or upon certain post-use treatment. Diverting agents have also been employed for other purposes than those described above, such as for altering the geometry of a fluid channel so as to change the transport characteristics of fluids moving through such channels. For example, in U.S. Pat. No. 3,818,990, a breakable gel is placed in the upper portion of a fracture over an underlying bed of solid proppant to form a fluid block at this location. The purpose of this procedure is to enable fluid pressure and flow direction to be controlled so as to wash across the top of the proppant particles and displace them through the developed flow channel to the outer reaches of the fracture. Relocation of the proppant in this fashion enables production of hydrocarbons through the fracture to be stimulated. After displacement of the solid particles of proppant, it may, in some instances, be desirable to remove the gel and position new, additional proppant at the location formerly occupied by the displaced proppant. Techniques for gel breaking and removal are well understood in the art.

The present invention provides a method by which undesirable fluid migration at a portion of a fracture boundary can be shut off, and in the course of the procedure, production of hydrocarbons into the fracture from a producing interval defining the remainder of the fracture can be stimulated. The method makes use of a plugging or sealing material and a removable diverting material placed in the fracture at particular times and places for accomplishing these primary objectives.

More specifically considered, the process of the invention is used where a producing well stimulated by fracturing is producing at a less then optimum rate or economy due to the fracture having, in part, extended into a subterranean zone which, because of its permeability or fluid content, has a deleterious effect upon the production of hydrocarbons originating at a portion of the fracture face contiguous to that zone. Typically, and in an important aspect of the invention as it can be beneficially employed in one way, the laterally extending fracture has been projected to a locus where its lower side is bounded by a predominantly water-producing zone, and its upper side is bounded by a hydrocarbon producing interval which is relatively free of producible water. In other instances, the lower boundary of such a laterally extending fracture may be constituted by a very high permeability formation constituting a thief zone which either interferes with further fracturing, or decreases hydrocarbon production, due in either case to the preferential passage of fluid into the interstices of such formation.

Both of the described situations result from the considerable difficulty of precisely controlling the vertical extent of artificially induced fractures propagated laterally into a subterranean location for purposes of enhancing production. Prior to the present invention, the efforts to cope with the described situations have often consisted of injecting material intended to set up to a solid or semi-solid state into the lower portion of the fracture for purposes of blocking or shutting off the encroaching water. This technique is less than optimum, however, due to the difficulty of controlling the shutoff material placement so that the solidified material does not contact and block a portion of the upper, hydrocarbon producing formation and thus in itself reduce hydrocarbon production.

In a broad sense, the method of the invention can be viewed as assuming the development of a vertical or near vertical fracture in a subterranean formation, using conventional techniques and carried out for the purpose of stimulating hydrocarbon production. It may be further assumed that such vertical or near vertical fracture extends in part into a zone which can, with benefit, be blocked or occluded from fluid flow across the fracture-zone interface, and in part into a hydrocarbon producing interval, or at least an interval which produces a hydrocarbon-containing fluid mixture which is substantially richer in the hydrocarbon component than is a fluid which enters the fracture from the zone to be blocked. Given this context, the invention then comprises the steps of first introducing or emplacing a porous bed of solid particles against that face of the fracture which is defined by the zone which can be beneficially blocked or occluded to prevent or reduce undesirable flow of fluid across the fracture-zone interface at this location. With the porous bed of solid particles so located within the fracture, a removable diverting material susceptible to pumping into the fracture is then placed in all or a portion of the fracture which is not occupied by the bed of solid particles, and is allowed to set up to a solid or semi-solid state at that location. The essential aspect of the location of this removable diverting material is that it form a barrier within the fracture at a location such that a sealing material subsequently passed from the well bore into the fracture will be diverted in its path of flow so as to substantially entirely enter the interstices between the solid particles in the porous bed, and will not contact the predominantly hydrocarbon-producing interval.

With the diverting material placed in the fracture and the porous bed of solid particles in place, a sealant material is then pumped through the well bore and into the bed of solid particles so as to enter the interstices of the solid particles and form a substantially continuous mass of material overlying the fracture-zone interface. As the sealant solidifies, a fluid-impermeable plug or barrier is formed at this location which blocks or substantially impedes the transfer of fluids across the interface and through this portion of the fracture. In the case of a water-bearing zone which supplies undesirable water to the fracture for admixture with the hydrocarbons under production, the sealant barrier thus formed will prevent such water flow. Where the blocked zone is a thief zone, loss of hydrocarbons or fracturing fluid from the fracture to the thief zone will be prevented by the sealant barrier. The same advantage of thief zone blockage is provided where such zones are encountered adjacent an injection well in secondary and tertiary recovery situations.

After the sealant material has set up in the interstices of the solid particles in the porous bed to form a plug or barrier at the fracture-zone interface, the removable diverting material is removed from the fracture via the well bore. Removal of the diverting material, which may be a gel containing an internal breaker or other type of known diverting material, can be accomplished in accordance with techniques well understood in the art. Such removal of the diverting material opens the fracture to the flow of hydrocarbons from the interval, and the well can then again be placed on stream for production purposes. The quality and/or quantity of production is thus substantially enhanced by the prevention of water infiltration and admixture with the hydrocarbons, or by the prevention of undesirable hydrocarbon loss to the thief zone.

In a preferred method of practice of the present invention, the diverting material which is utilized in a portion of the fracture includes a solid proppant material. The particles of the proppant thus moved into the fracture as a constituent of the diverting material are left in position in the fracture when the diverting material is to be removed to provide a permeable bed of proppant which aids in hydrocarbon production by maintaining the fracture width against the closing propensities of overburden forces.

The drawings schematically illustrate the steps carried out in the process of the invention, and as typified by an application of the process which is of particular value. This application is the sealing off of a water-bearing zone into which the lower side of a fracture used in stimulating hydrocarbon production has been extended.

In the drawings:

FIG. 1 schematically illustrates a fracture extending from a well bore into both a hydrocarbon-producing formation and a water-producing zone. A particulate material is being placed in the fracture while entrained in a liquid carrier.

Figure 2:
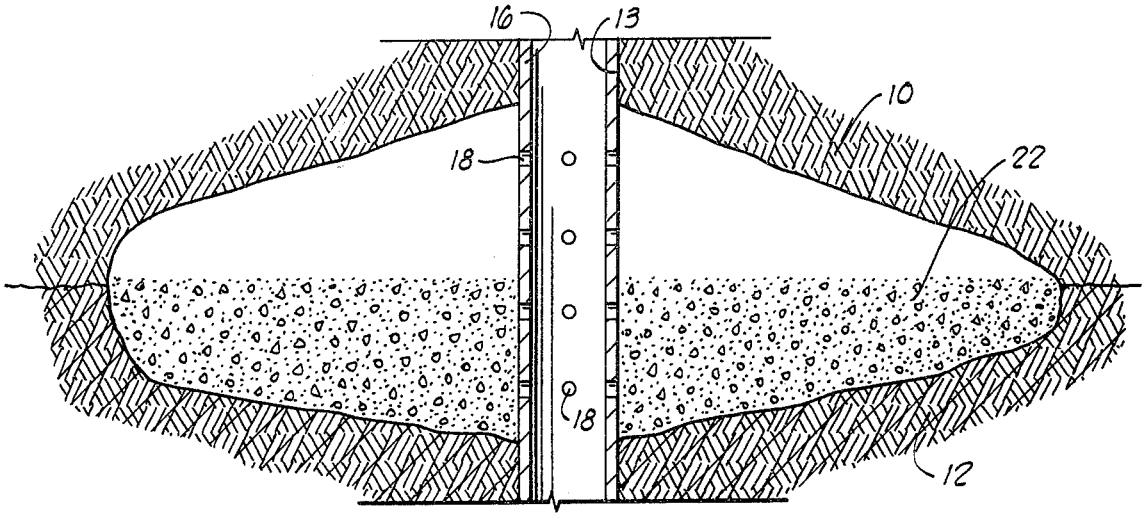

FIG. 2 schematically illustrates the position of the settled particulate material in the fracture illustrated in FIG. 1.

Figure 3:
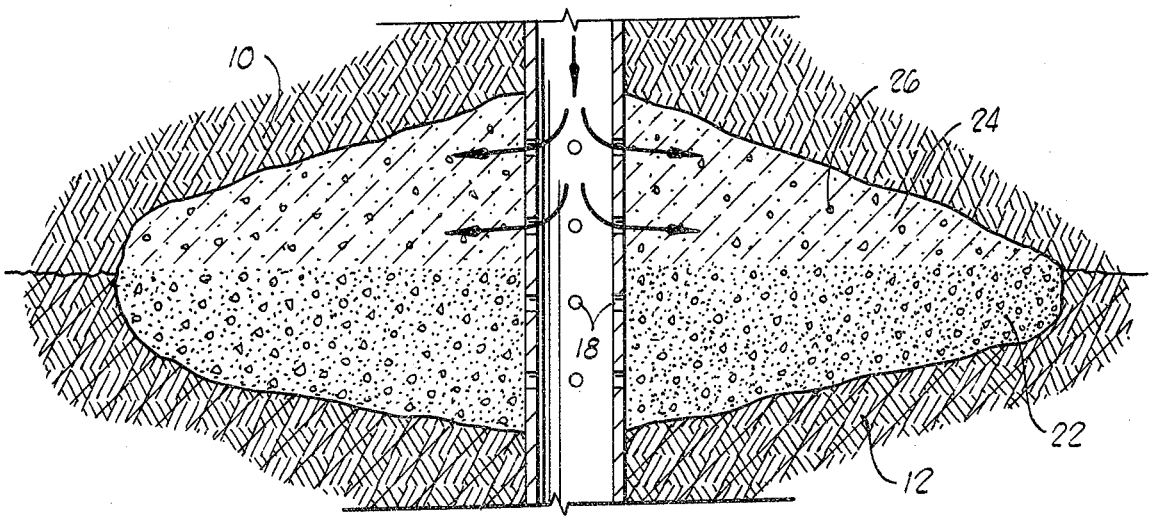

FIG. 3 schematically illustrates the placement of a settable diverting material in the fracture over the settled particulate material.

Figure 4:
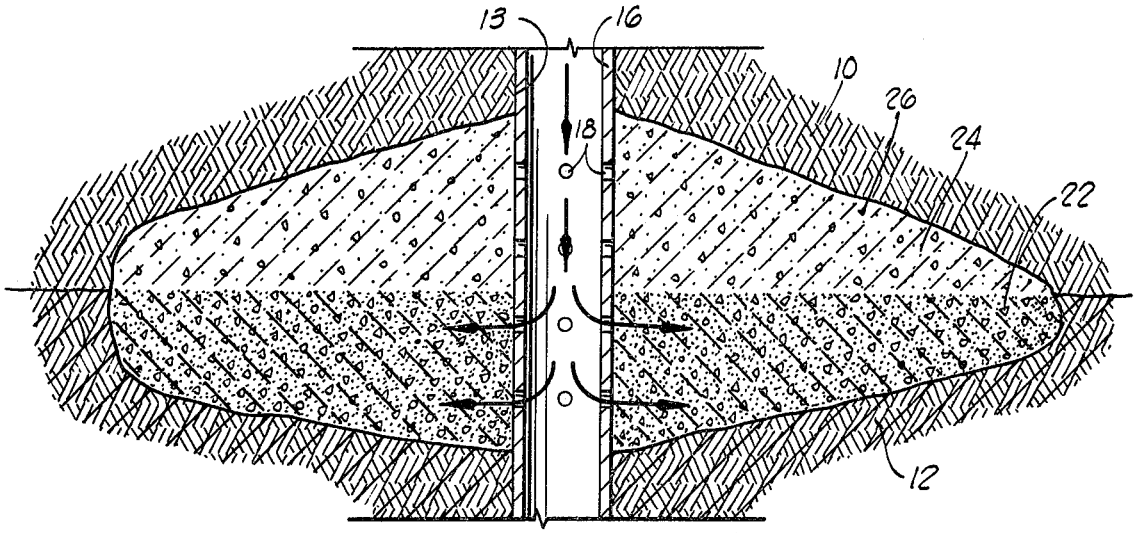

FIG. 4 schematically illustrates the placement of a sealing material in the interstices of the settled particulate material.

Figure 5:
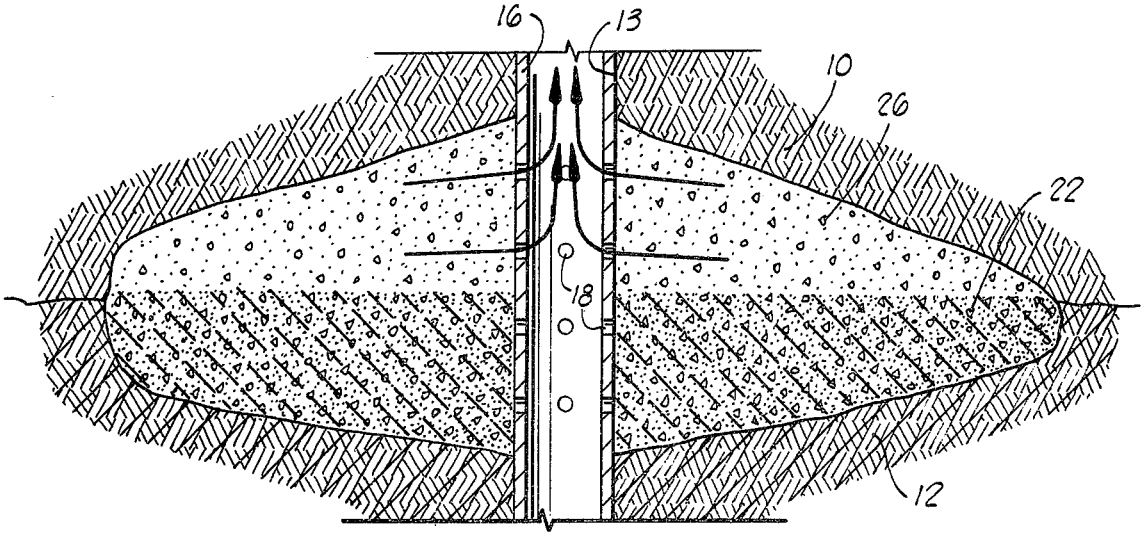

FIG. 5 schematically illustrates one method of removal of the diverting material.

In FIG. 1, an oil-bearing subterranean formation 10 is illustrated as being located directly over a water-bearing zone or formation 12. Both may be traversed by a well bore 13 lined with a casing 16 which is perforated, as shown at 18, in horizontal alignment with a fracture 20. The fracture 20 has been formed by any conventional hydraulic fracturing technique suitable to the particular character of the fractured formation and production problems encountered. The fracture 20, in the course of development, is extended laterally from the well bore 13, and has a vertical dimension such that the lower portion of the fracture extends into the predominantly water-bearing interval 12, and the upper portion of the fracture is bounded by the interval which produces primarily oil. The oil and water produced from these two locations become undesirably commingled in the course of production from the illustrated subterranean location. This commingling is reduced by the process of this invention by carrying out the steps to which reference has hereinbefore been made, and which are shown in the several views of the drawings.

As shown in FIG. 1, the initial step entails placing in the fracture 20 a composition which consists of a relatively low viscosity liquid carrier having a particulate material 22 suspended therein. The liquid carrier can very suitably be one of a number of fluids now used for hydraulic fracturing, including, for example, water, acid and liquid hydrocarbons. The viscosity of the liquid carrier is sufficiently high that the particulate material can be entrained therein and moved downhole and outwardly into the fracture, but will settle out of the liquid carrier relatively quickly as the carrier moves outwardly in the fracture, and fills the fracture so as to ultimately become static. Thickening agent additives which can be selectively employed to adjust the viscosity of the carrier liquid are well known in the art. Many of the solid particulate materials now conventionally used as proppants can be utilized as the solid component of the composition. The size and shape of the particles should be such that the fluid sealant material hereinafter described can move into and through the interstices of these particles when they are accumulated in a solid bed upon the bottom of the fracture 20. A preferred solid particulate material is sand. Examples of other suitable solids are walnut hulls, sintered bauxite and glass beads.

The carrier liquid moves the particulate material 22 out into the fracture as shown in FIG. 1, and then allows it to settle out and deposit on the bottom of the fracture to build up a porous bed of particles of sufficient height that the fracture interface with the water-producing zone will be adequately covered. The quantity of the particulate material required is dependent upon the height, length and width of the interface of the fracture with the water-producing zone 12. As an example, for an interface having a width of 0.25 inch, a height as measured vertically along the fracture of 50 feet, and extending over a horizontal length of 100 feet, (on each of the two opposite sides of the well bore), about 200 cubic feet (20,000 lbs.) of sand would be required. The particular size and type of the solid particles used will be determined in any given case by the transport characteristics of the carrier fluid, and the resulting fracture flow capacity. Industry accepted mathematic equations can be used to assist in determining the most appropriate fluid viscosity and solid particle type, size and quantity to utilize. Composition viscosities in the range of from about 0.2 to about 200 cp. will be satisfactory in most cases. Typically, the composition is moved into the fracture at a velocity of between 0.1 and about 50 barrels per minute.

Although the majority of the solid particles settle from the relatively low viscosity carrier liquid as it is being pumped into the fracture, at the time pumping is terminated some of the solid particles will remain temporarily suspended in the liquid. The time then required for the solid particles to settle to the bottom of the fracture is dependent upon the terminal settling velocity of the particles in the particular liquid in use, and the distance the particle must fall to reach the interface of the fracture and water-bearing zone, or the upper side of the bed of particles commencing to accumulate over the interface. For example, a 20–40 mesh sand has a terminal settling rate of 0.35 ft/sec. in water. Thus, if sand of this type were used, and it were necessary to traverse a distance of 25 feet in the course of falling, 71.4 seconds would be required for the sand particles to settle out.

The appearance of the settled particles 22 as they accumulate in a bed which overlies the fracture-water bearing zone interface is shown in FIG. 2. After the solid particles 22 settle to the location depicted in FIG. 2, the carrier liquid used to transport the solid particles into the fracture 20 can be gradually removed from the fracture by releasing the pressure thereon and allowing the withdrawal of the carrier fluid in a commingled state with oil being produced from the oil-bearing formation 10. More frequently, however, the carrier fluid will be simply displaced into the pores of the formation adjacent the fracture by the diverting material which is next placed in the fracture.

With the carrier fluid substantially displaced into the fracture 20, a viscous temporary or removable diverting material 24 is pumped down the well bore 13 into the fracture at a location over the bed of solid particles 22. The diverting material is a viscous liquid having good transport characteristics for a suspended solid particulate material 26. The transport liquid has the ability to set to a solid or semi-solid state in the fracture such that an extremely viscous temporary plug is formed after the diverting material is placed in the fracture. In placing the diverting material, it is pumped at a pressure sufficiently low that it will not displace or significantly disturb the particles 22 in the porous bed.

Compositions having the capability of gelling, or becoming semi-solid impermeable bodies by thixotropic development, or other setting mechanisms, are well known in the technology of hydrocarbon production. For example, an aqueous solution of guar gum containing one of a number of known internal breakers (such as cellulase) can be introduced into the fracture under controlled conditions of fluid flow rate, formation temperature and fluid pressure to enable an impermeable, semi-solid body of guar gum gel to be developed within the fracture. Other materials which can also be utilized for the necessary in-situ gellation include, for example, gellable aqueous compositions containing water soluble cellulose derivatives (such as hydroxyethylcellulose, carboxymethylcellulose, carboxymethylhydroxyethylcellulose, methylcellulose or sulfopropylcellulose), water soluble synthetic polymers (such as polyacrylamide, polymethacrylamide, polyacrylic acid or sodium polyacrylate), gellable hydrocarbon compositions and occasionally cement. In some instances, gelling or viscosity increase is effected through the inclusion of a cross-linking agent which causes the viscosifier or gelling agent to undergo cross-linking. Examples of such cross-linking agents include borate salts and metals such as aluminum, tin, titanium and antimony.

The considerations which enter into the selection of the solid proppant particles will be substantially those which control the selection of this type of material in commonly practiced fracturing operations, and will be dependent upon the interplay of the same factors which are characteristic of the particular production problems then encountered and without reference, in most instances, to the character of the underlying porous bed of solid particles. It should be pointed out, however, that in many cases it will be desirable to use the same type of solid particles as a proppant material suspended in the gellable carrier fluid utilized to form the diverting material composition as are used in the laying down of the porous bed of solid particles at the bottom portion of the fracture.

The removable diverting material utilized above the porous bed of solid particles should be allowed adequate time, after emplacement, to set up to the described solid or semi-solid state. The time required for such setting is dependent upon a number of factors, such as the type of liquid used in the diverting material, the setting mechanism which is involved, the pH and the temperature of the composition at the time of the curing or setting process. For example, if an aqueous guar gum solution containing a complexing agent is utilized, the time required for setting to a gel is primarily dependent upon the pH of the system. With a pH of approximately 6.0, from about 30 minutes to about 1 hour is required over a wide range of the most often encountered bottom hole temperatures.

With the removable diverting material 24 positioned in the fracture 20 over the porous bed of solid particles 22, and located to protect the hydrocarbon-producing interval as shown in FIG. 3, a fluid sealing material is pumped into the porous bed of solid particles located in the lower portion of the fracture, and covering the water-producing zone. The sealant material is diverted by the diverting material into the porous bed in the manner shown in FIG. 4. The sealing material can be any composition which will form a permanent plug in conjunction with the solid particles 22, thus shutting off, or very substantially reducing, water production from the water-bearing zone 12. A very suitable sealing material for such usage is acidified grade 40 sodium silicate. A cross-linked polyacrylamide can also be utilized. Additional sealing materials of this general character are described in U.S. Pat. Nos. 3,623,770 and 3,223,163. The sealing material penetrates the interstices of the solid particles in the bed at the lower side of the fracture, and sets up in this location to form the impermeable barrier required to shut off water flow from the water zone. It will frequently be desirable to selectively control the pH of the sealing material so as to procure the setting time and rate desired.

The sealing material introduced to the interstices of the solid particles in the bed at the lower side of the fracture is allowed sufficient time to set up to a solid state, and during this time interval, the removable diverting agent can be subjected to the action of internal breakers or other removing influence to alleviate the temporary plug constituted thereby. In most instances, a gel type removable diverting agent will be permitted to "break" or reduce to a low viscosity fluid such that it can be recovered via the well bore or displaced into the formation to leave the propping agent previously suspended therein in the portion of the fracture which projects into the hydrocarbon-producing interval. Examples of conventional and widely used breakers for various types of gels, and particularly for guar gum gels, are oxidizing breakers such as ammonium persulfate and sodium persulfate, enzyme breakers such as cellulase and hemicellulase, and acids such as hydrochloric, formic and fumaric acids.

Preferably, the times required for breaking or reducing the viscosity of the removable diverting material 24, and for setting up of the sealing material in the interstices of the solid particles 22 in the porous bed, are somewhat synchronized so that the solid, fluid-impermeable barrier at the lower portion of the fracture is permanently established at about the time that the liquid portion of the removable diverting material has broken and been removed, and the proppant material entrained therein left in place in the upper portion of the fracture. Typically, a system requiring about 4 hours for a sodium silicate sealant system to set and a guar gum gel to concurrently break can be utilized.

FIG. 5 of the drawings illustrates one method of removal via the well bore of the base liquid resulting from the breaking of the gel or removable diverting material, leaving the solid proppant particles in place.

It should be pointed out that other materials, such as nonemulsifying agents, pH control additives, and fluid loss additives, can be added in selected, generally small amounts to the several fluids used in the practice of the invention to impart certain desirable properties to these fluids in accordance with techniques which are conventional and well understood in the art.

The following example of the practice of the invention will aid in its understanding.

The main pay interval of the San Andreas formation in Yoakum County, Texas, lies at a depth of from 5,000 feet to 5,200 feet. It is hydraulically fractured to yield a fracture having a height of 200 feet, an average width of 0.19 inches and an average distance of horizontal extension from the well bore of about 220 feet. Approximately one-half the total height of the fracture (the lower 100 feet) traverses a zone highly saturated with water. The bottom hole temperature of the well is 100° F. and the bottom hole treating pressure is 4,000 psi. The formation has an average overall permeability of 5 md, and an average porosity of 12 percent.

For the purpose of placing a bed of solid proppant particles in the lower portion of the fracture adjacent the water zone, 10–20 sand is mixed into a low viscosity fracturing fluid to provide a sand concentration in the fluid of 2.0 pounds/gallon. The low viscosity fracturing fluid is water containing 1 weight percent potassium chloride, and the following additional additives per 1000 gallons of water:

30 lbs. of silica flour (as a fluid loss additive)
30 lbs. of guar gum (as a viscosifier)
10 lbs. of sodium dihydrogen phosphate (for pH control)

A small amount of ethoxylated alcohol is also added as a nonemulsifying agent.

The low viscosity fluid carrying the suspended sand is injected into the fracture at a rate of 15 barrels per minute until 40,000 gallons of the fluid has been placed. 690 sacks of the 10–20 sand are required for this volume of emplaced sand-carrying fracturing fluid. Pumping is then stopped and the sand is permitted to settle to the bottom of the fracture. Following this step 218 feet of the fracture is covered to a depth of 100 feet by the sand.

A temporary diverting material is next prepared using as a base liquid the potassium chloride-containing water described above. To the water (per each 1000 gallons) are added 80 pounds of guar gum, 3 gallons of potassium pyroantimonate (as a gelling cross-linker), 20 pounds of sodium dihydrogen phosphate and small amounts of a non-emulsifying agent and cellulose to function as a gel breaker. To this composition a solid particulate proppant is then added at the rate of 0.77 pounds per gallon.

The temporary diverting material as thus constituted is pumped via the well bore into the upper portion of the fracture at a rate of 10 barrels per minute. 10,000 gallons of the diverting material are pumped into the fracture, requiring a total of 40 sacks of the proppant. The volume of the fracture occupied by the diverting material, when in place, is 200 feet in length and 100 feet in height. After emplacement of the diverting material, the well is shut in for a period of 2 hours to permit the diverting material to set up to a semi-solid, high strength gel.

A sealant material composed of 16% Grade 40 sodium silicate containing a latent acid catalyst and having a viscosity of 1.5 centipoises is injected into the fracture from the well bore, and is diverted by the emplaced diverting material into the interstices of the 10–20 sand bed laid down in the lower portion of the fracture in the first step of the procedure. 3000 gallons of the sealant material are injected to completely fill the interstices in the sand bed. This volume is adjusted to account for fluid loss to the formation.

The well is then shut in and the sealant permitted to set up to a strong, solid gel. During this time, the internal breaker (the cellulase) in the temporary diverting agent commences to break the gelled diverting agent. After about 6 hours, breaking of the diverting agent is complete and the sealant material has set up to a semi-solid state. The broken liquid portion of the diverting material is then pumped from the well, and the well is returned to production. A 3.8-fold increase in hydrocarbon production is realized after completion of the described procedure.

Although certain preferred embodiments of the invention have been herein described in order to illustrate the basic principles which underlie the invention, various changes and innovations can be effected from the precise exemplary procedures and materials cited without departure from these principles. Such changes and innovations are therefore deemed to be within the spirit and scope of the invention, unless they are necessarily excluded therefrom by the appended claims or reasonable equivalents thereof.

What is claimed is:

1. A process for isolating first and second zones within a subterranean formation traversed by a common fracture extending from a well bore wherein said first zone is vertically lower in said subterranean formation than said second zone, said process comprising the steps of:

flowing a carrier liquid containing solid particles into said fracture; and permitting said particles to settle by gravity from said carrier liquid into said first zone whereby a porous bed of solid particles is formed in said fracture to substantially cover the face of said fracture contiguous to at least a portion of said first zone; then introducing a temporary and removable diverting material into the fracture at a location therein contiguous to said second zone, and positioned to divert into said porous bed a fluid sealing material moving from the well bore into the fracture; then introducing a settable fluid sealing material into the interstices of the solid particles in said porous bed; then permitting said sealing material to set up to a sealing status; and finally removing at least a portion of said diverting material from the fracture to facilitate fluid communication between said second zone and said well bore via said fracture.

2. A process as defined in claim 1 wherein said removable diverting material comprises:

a fluid capable of setting to a solid status upon standing statically in the fracture; and solid proppant particles for propping the fracture over said porous bed.

3. A process as defined in claim 2 wherein said diverting material fluid is water containing guar gum, a complexing agent and an internal breaker.

4. A process as defined in claim 2 wherein said solid proppant particles are sand.

5. A process as defined in claim 1 wherein said settable fluid sealing material is introduced by passing said fluid sealing material from the well bore into the fracture against the diverting material and into said solid particle interstices.

6. A process as defined in claim 1 wherein said removed portion of the diverting material is removed by converting it to a liquid and flowing it out of the fracture.

7. A process as defined in claim 6 wherein said removed portion of said diverting material is a breakable gel.

8. A process as defined in claim 1 wherein said diverting material includes solid particles and said removed portion thereof.

9. A process as defined in claim 8 wherein the solid particles constituting a part of said diverting material are sand.

10. A process as defined in claim 1 wherein said solid particles in said porous bed are proppant particles suitable for propping open said fracture.

11. A process as defined in claim 1 wherein said second zone produces hydrocarbon to the fracture and said first zone produces substantially more water to the fracture than is produced by said second zone.

12. A process as defined in claim 1 wherein said liquid containing said solid particles is water containing a viscosity adjusting agent, and having its viscosity adjusted to transport said solid particles into said fracture.

13. A process as defined in claim 1 wherein said sealing material is a sodium silicate composition.

14. A process as defined in claim 1 wherein said diverting material is a time setting gellable composition containing an internal breaker.

15. A process as defined in claim 14 wherein said sealing material and gellable composition are selected to cause said sealing material to set to a sealing status concurrently with the breaking of said gellable composition to facilitate removal of a portion thereof.

16. A process as defined in claim 14 wherein said carrier fluid is water containing a viscosity adjusting agent, and having its viscosity adjusted to transport said solid particles into said fracture.

17. A process as defined in claim 14 wherein said sealing material is a sodium silicate composition.

18. A process as defined in claim 14 wherein said gellable composition is an aqueous guar gum solution.

19. A process for vertically isolating a hydrocarbon producing formation from a lower contiguous water zone in a subterranean locus comprising:

introducing into a fracture formed in said locus, wherein said fracture extends into said hydrocarbon producing formation and into said water zone, a quantity of proppant material sufficient to fill at least a major part of the portion of said fracture extending into said water zone;

permitting said proppant material to settle in said portion of said fracture in said water zone to thereby form a fluid-conductive bed of proppant therein;

introducing into the portion of said fracture extending into said hydrocarbon producing formation a gellable fluid to thereby form a non-conductive plug therein;

introducing into said proppant bed a quantity of sealing material sufficient to fill the pore volume of said proppant bed;

permitting said sealing material to set in said proppant bed to form a non-conductive plug occluding water flow from said water zone to said fracture; and removing said gellable fluid from said hydrocarbon producing formation.

20. A process as defined in claim 19 and further characterized as including the steps of suspending a proppant in said gellable fluid as said gellable fluid is introduced into the portion of said fracture extending into said hydrocarbon producing formation; and maintaining said proppant particles in the portion of the fracture extending into said hydrocarbon producing formation when said gelled fluid is removed from said hydrocarbon producing formation.

21. A method for reducing fluid flow from and to a subterranean zone contiguous to and vertically lower than a hydrocarbon producing formation which includes the steps of:

initially extending a common fracture laterally into the zone and into the formation to locate a portion of the fracture in each of the zone and the formation; then introducing a porous bed of solid particles into that portion of the fracture located in the zone by flowing a carrier liquid containing solid particles into said fracture and permitting said particles to settle by gravity from said carrier liquid into the zone;

introducing into that portion of the fracture located in the formation and adjacent the locus of the bed of solid particles, a removable diverting agent to block the portion of the fracture occupied by the diverting material to a selected fluid sealing material;

introducing into the interstices of the particles in the porous bed, a selected fluid sealing material which is diverted thereinto by said diverting material;

setting said selected sealing material into a fluid-impermeable seal to impede fluid flow to and from said zone; and removing said diverting material to facilitate hydrocarbon production from the formation.

22. A method for simultaneously propping an upper portion of a fracture and sealing a lower portion of said fracture within a fractured formation comprising:

introducing a low viscosity proppant-carrying fluid into the fracture;

permitting the proppant to settle out of the low viscosity fluid into the lower portion of the fracture;

introducing a proppant-carrying gel-forming fluid into the upper portion of the fracture;

permitting a gel to form in the upper portion of the fracture to thereby produce a proppant-containing plug in the upper portion of the fracture over the proppant settled out of the low viscosity fluid into the lower portion of the fracture;

introducing a sealing material into the lower portion of the fracture and into the interstices of the proppant settled into the lower portion of the fracture;

permitting said sealing material to set to a sealing status, and permitting said gel plug to break; and removing said broken gel from the fracture to thereby produce a fracture having a sealed lower portion and a propped upper portion.

23. The method defined in claim 22 wherein said sealing material is permitted to set to a sealing status simultaneously with the breaking of said gel plug and over substantially the same time interval.

* * * * *

UNITED STATES PATENT AND TRADEMARK OFFICE

CERTIFICATE OF CORRECTION

PATENT NO. : 4,157,116

DATED : June 5, 1979

INVENTOR(S) : Gerald R. Coulter

It is certified that error appears in the above-identified patent and that said Letters Patent are hereby corrected as shown below:

At Column 8, in line 30, the word "cellulose" should read --cellulase--.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*